US009696025B2

(12) United States Patent
Zhang

(10) Patent No.: US 9,696,025 B2
(45) Date of Patent: Jul. 4, 2017

(54) LIGHT WITH DYNAMIC LIGHTING EFFECT

(71) Applicant: Gemmy Industries Corp., Coppell, TX (US)

(72) Inventor: Cheng-Chun Zhang, Shenzhen (CN)

(73) Assignee: Gemmy Industries Corp., Coppell, TX (US)

( * ) Notice: Subject to any disclaimer, the term of this patent is extended or adjusted under 35 U.S.C. 154(b) by 0 days.

(21) Appl. No.: 15/200,291

(22) Filed: Jul. 1, 2016

(65) Prior Publication Data

US 2016/0312995 A1 Oct. 27, 2016

Related U.S. Application Data

(63) Continuation of application No. 14/145,512, filed on Dec. 31, 2013, now Pat. No. 9,599,329.

(51) Int. Cl.
*F21V 33/00* (2006.01)
*F21S 10/00* (2006.01)
(Continued)

(52) U.S. Cl.
CPC ..... *F21V 33/0028* (2013.01); *A63G 31/12* (2013.01); *A63H 3/006* (2013.01);
(Continued)

(58) Field of Classification Search
CPC ..... A63G 31/12; A63H 3/06; F21V 5/004; F21V 5/008; F21V 5/04; F21V 14/02;
(Continued)

(56) References Cited

U.S. PATENT DOCUMENTS 3,263,069 A 7/1966 Krucki et al.
3,949,350 A * 4/1976 Smith ..... F21S 6/002 362/231
(Continued)

FOREIGN PATENT DOCUMENTS

DK PA 2013 00566 9/2014
DK PA 2013 70677 9/2014
DK PA 2013 70679 9/2014

OTHER PUBLICATIONS

Notice of Allowance issued Feb. 27, 2015 in U.S. Appl. No. 14/079,628.
(Continued)

*Primary Examiner* — Anh Mai
*Assistant Examiner* — Steven Horikoshi
(74) *Attorney, Agent, or Firm* — Venable LLP; Steven J. Schwarz

(57) ABSTRACT

An inflatable display with dynamic lighting effect has an inflatable body, an air pump inflating the inflatable body, and a lighting assembly mounted inside the inflatable body for providing dynamic lighting variations. The lighting assembly has a light housing, a power supply, a lighting module, and a refracting module mounted in the light housing. The lighting module and the refracting module rotate relative to each other. As light beams emitted from the lighting module pass through the refracting module, the light beams are mixed and refracted. With relative rotation of the lighting module and the refracting module, the light beams can project outwards to further penetrate through the inflatable body at different angles covering a large area to form the dynamic lighting variations and to exhibit the dynamic lighting effect.

6 Claims, 6 Drawing Sheets

(51) Int. Cl.

| | |
|---|---|
| ***F21V 13/02*** | (2006.01) |
| ***F21V 17/02*** | (2006.01) |
| ***F21V 31/04*** | (2006.01) |
| ***F21V 5/00*** | (2015.01) |
| ***F21V 5/04*** | (2006.01) |
| ***A63H 27/10*** | (2006.01) |
| ***A63G 31/12*** | (2006.01) |
| ***A63H 3/00*** | (2006.01) |
| ***A63H 3/06*** | (2006.01) |
| ***F21V 3/02*** | (2006.01) |
| ***F21V 29/73*** | (2015.01) |
| ***F21V 14/06*** | (2006.01) |
| ***F21V 23/00*** | (2015.01) |
| ***F21V 23/02*** | (2006.01) |
| ***F21V 23/04*** | (2006.01) |
| *F21W 121/00* | (2006.01) |
| *F21S 10/02* | (2006.01) |
| *F21V 13/12* | (2006.01) |
| *F21Y 101/00* | (2016.01) |
| *F21Y 115/10* | (2016.01) |
| *F21Y 113/13* | (2016.01) |

(52) U.S. Cl.

CPC ..... *A63H 3/06* (2013.01); *A63H 27/10* (2013.01); *F21S 10/007* (2013.01); *F21V 3/026* (2013.01); *F21V 5/00* (2013.01); *F21V 5/008* (2013.01); *F21V 5/04* (2013.01); *F21V 13/02* (2013.01); *F21V 14/06* (2013.01); *F21V 17/02* (2013.01); *F21V 23/001* (2013.01); *F21V 23/023* (2013.01); *F21V 23/0407* (2013.01); *F21V 29/73* (2015.01); *F21V 31/04* (2013.01); *A63H 2027/1033* (2013.01); *A63H 2027/1058* (2013.01); *F21S 10/02* (2013.01); *F21V 13/12* (2013.01); *F21W 2121/00* (2013.01); *F21W 2121/006* (2013.01); *F21Y 2101/00* (2013.01); *F21Y 2113/13* (2016.08); *F21Y 2115/10* (2016.08)

(58) Field of Classification Search

CPC ..... F21V 14/025; F21V 14/06; F21V 14/065; F21V 13/026; F21S 10/026; F21S 10/046; F21S 10/06; F21S 10/063; F21S 10/066; F21W 2121/00

USPC ..... 362/92, 121, 186

See application file for complete search history.

(56) References Cited

U.S. PATENT DOCUMENTS

| | | | |
|---|---|---|---|
| 4,249,331 | A | 2/1981 | Vernon |
| 4,870,548 | A | 9/1989 | Beachy et al. |
| 5,688,042 | A | 11/1997 | Madadi et al. |
| D414,579 | S | 9/1999 | Denison et al. |
| 6,050,697 | A | 4/2000 | Bennington |
| 6,474,837 | B1 | 11/2002 | Belliveau |
| 6,786,793 | B1 | 9/2004 | Wang |
| 7,033,037 | B2 | 4/2006 | Chen |
| 7,063,553 | B1 | 6/2006 | Mullen |
| D542,959 | S | 5/2007 | Yao |
| D559,091 | S | 1/2008 | Skorka |
| 7,320,533 | B1 | 1/2008 | Beadle |
| D574,532 | S | 8/2008 | Lee et al. |
| D625,871 | S | 10/2010 | Huang |
| D659,871 | S | 5/2012 | Lee et al. |
| 8,262,252 | B2 | 9/2012 | Bergman et al. |
| D773,707 | S | 12/2016 | Lentine |
| 2003/0231497 | A1 | 12/2003 | Sakata et al. |
| 2005/0243560 | A1 | 11/2005 | Chen |
| 2007/0097681 | A1 | 5/2007 | Chich et al. |
| 2009/0027900 | A1 | 1/2009 | Janos et al. |
| 2009/0122548 | A1 | 5/2009 | Dalsgaard |
| 2009/0185377 | A1 | 7/2009 | Johnson |
| 2009/0268466 | A1 | 10/2009 | Allegri |
| 2010/0091491 | A1 | 4/2010 | Jiang et al. |
| 2011/0116051 | A1 | 5/2011 | Young et al. |
| 2011/0194292 | A1 | 8/2011 | Tsai |
| 2011/0280015 | A1 | 11/2011 | Li et al. |
| 2011/0286200 | A1 | 11/2011 | Iimura et al. |
| 2012/0147608 | A1 | 6/2012 | Kawagoe et al. |
| 2012/0147609 | A1 | 6/2012 | Black et al. |
| 2012/0182743 | A1 | 7/2012 | Chou |
| 2012/0300429 | A1 | 11/2012 | Jin |
| 2013/0094193 | A1 | 4/2013 | Baxter et al. |
| 2013/0135866 | A1 | 5/2013 | Souvay et al. |
| 2014/0001507 | A1 | 1/2014 | Streppel et al. |
| 2014/0056011 | A1 | 2/2014 | Clement et al. |
| 2016/0215961 | A1 | 7/2016 | Kjeldsen et al. |

OTHER PUBLICATIONS

Office Action issued Apr. 9, 2015 in U.S. Appl. No. 14/098,594.
Office Action issued Mar. 9, 2017 in U.S. Appl. No. 15/341,730.
Notice of Allowance issued Mar. 29, 2017 in U.S. Appl. No. 29/554,097.

* cited by examiner

LIGHT WITH DYNAMIC LIGHTING EFFECT

CROSS-REFERENCE TO RELATED APPLICATIONS

This application is a continuation of U.S. application Ser. No. 14/145,512, filed on Dec. 31, 2013, the entire content of which is incorporated herein by reference in its entirety.

BACKGROUND OF THE INVENTION

1. Field of the Invention

The present invention relates to an inflatable display, especially to an inflatable display with dynamic lighting effect.

2. Description of the Prior Art(s)

Inflatable displays are normally used for occasions of all kinds of exhibitions, carnivals, and parties. Based on means of application and displaying, the inflatable displays can be classified into a stationary type and a wearable type. The stationary type of inflatable displays pertains to inflatable displays that are fixedly mounted in fields of the foregoing occasions. The wearable type of inflatable displays pertains to outfits that are worn by performers for purpose of decoration, advertisement, and entertainment.

A conventional inflatable display has an inflatable body and an air pump for inflating the inflatable body. As the conventional inflatable display is not luminous, entertaining and decorative effects of the conventional inflatable display are limited. Moreover, since many activities, such as Halloween parties, are held in a dusky occasion with dim light, the conventional inflatable display does not fit the dusky occasion.

In order to enhance the entertaining and the decorative effects of the conventional inflatable display, a lighting unit is mounted inside the inflatable body of the conventional inflatable display. However, the lighting unit only illuminates the conventional inflatable display, or flickers so as to generate lighting variations of the lighting unit. The lighting variations are limited and the entertaining and the decorative effects of the conventional inflatable displays are still not improved efficiently.

To overcome the shortcomings, embodiments of the present invention provide an inflatable display with dynamic lighting effect.

SUMMARY OF THE INVENTION

Embodiments of the present invention provide an inflatable display with dynamic lighting effect. The inflatable display has an inflatable body, an air pump inflating the inflatable body, and a lighting assembly mounted inside the inflatable body for providing dynamic lighting variations. The lighting assembly has a light housing, a power supply, a lighting module, and a refracting module mounted in the light housing. The lighting module and the refracting module rotate relative to each other.

As light beams emitted from the lighting module pass through the refracting module, the light beams are mixed and refracted. With relative rotation of the lighting module and the refracting module, the light beams can project outwards to further penetrate through the inflatable body at different angles covering a large area to form the dynamic lighting variations and to exhibit the dynamic lighting effect.

Other objectives, advantages and novel features of the invention will become more apparent from the following detailed description when taken in conjunction with the accompanying drawings.

DETAILED DESCRIPTION

Figure 1:
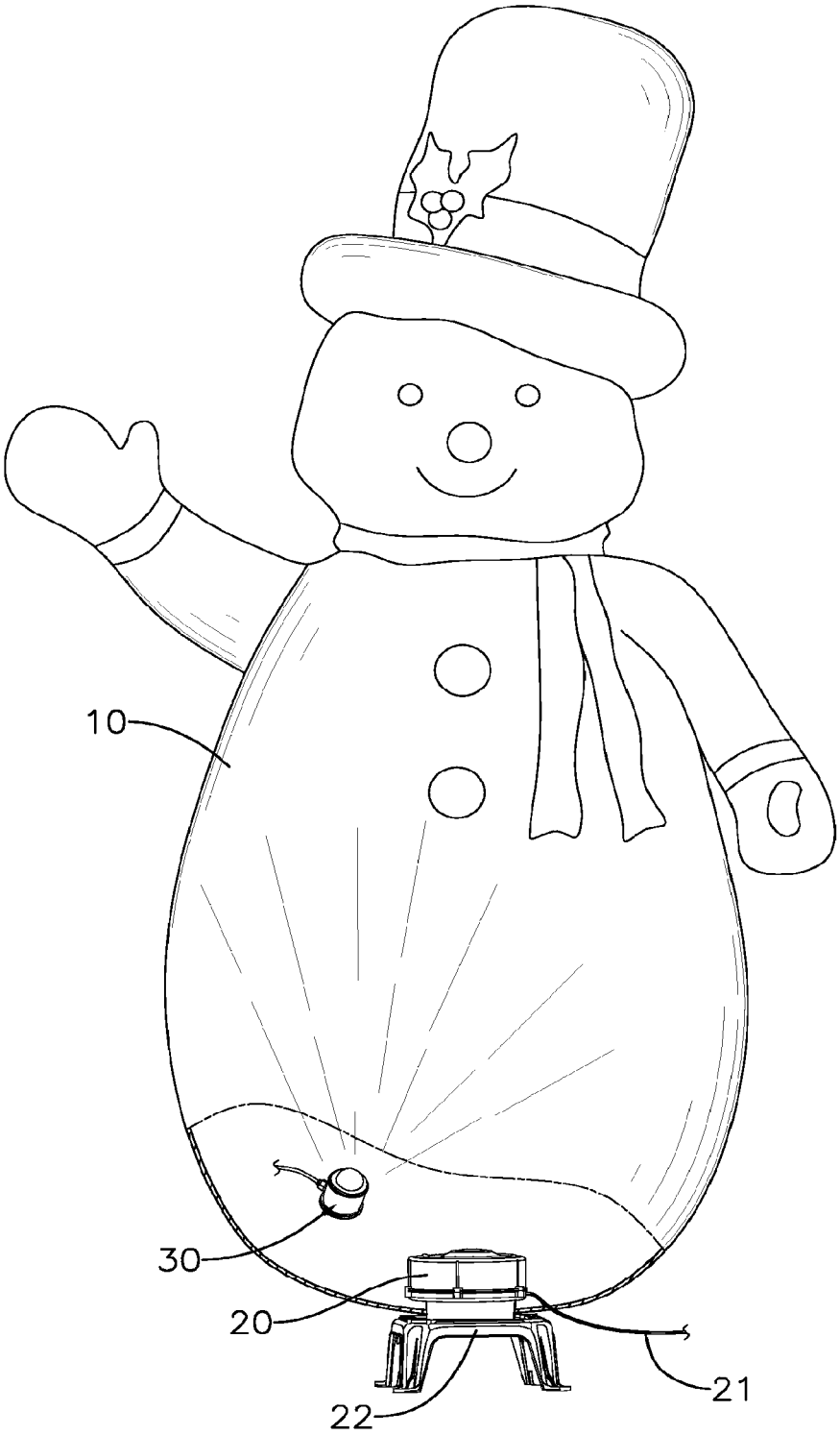
FIG. 1 is a perspective view of a first embodiment of an inflatable display with dynamic lighting effect in accordance with an embodiment of the present invention.

With reference to FIG. 1, in a first embodiment, an inflatable display with dynamic lighting effect in accordance with the present invention comprises an inflatable body 10, an air pump 20, and a lighting assembly 30.

The inflatable body 10 is transparent and has an inner wall and an air inlet. The air inlet is formed through the inflatable body 10. Preferably, the air inlet is formed through a bottom of the inflatable body 10.

The air pump 20 is mounted to the air inlet of the inflatable body 10 and has a power cord 21. The power cord 21 of the air pump 20 is connected to an external power source, such as a mains power, to provide an operating power to the air pump 20 so as to inflate the inflatable body 10. Preferably, the air pump 20 is mounted on and supported by a seat 22. Alternatively, the operating power of the air pump 20 may be supplied from batteries.

Figure 2:
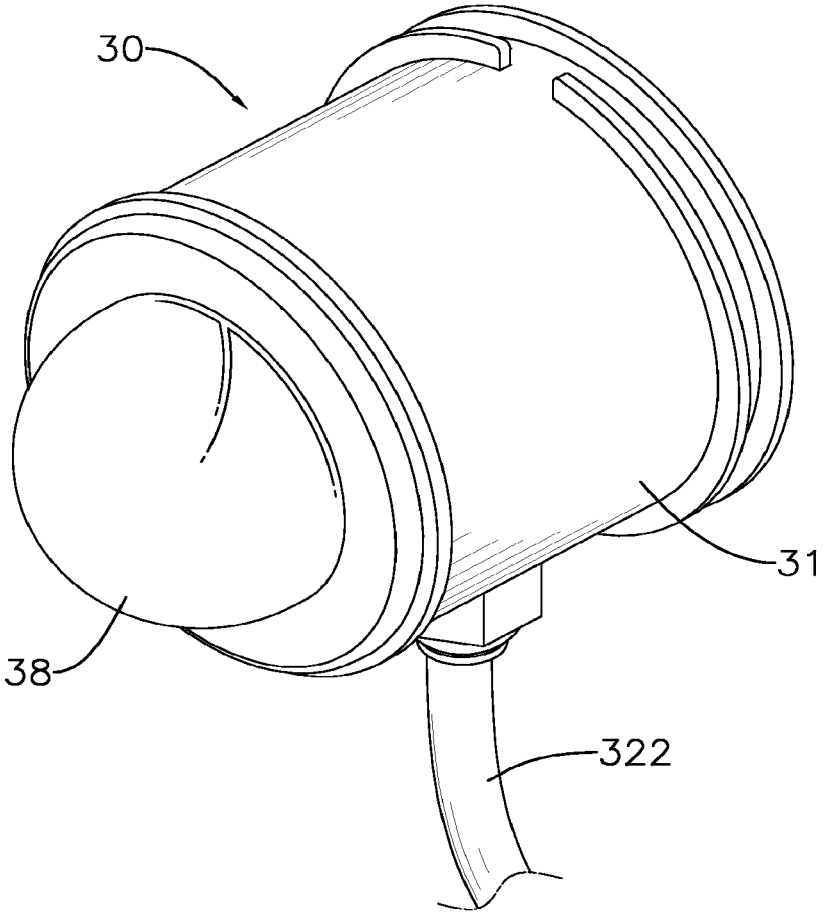
FIG. 2 is a perspective view of a lighting assembly of the inflatable display of FIG. 1.
Figure 3:
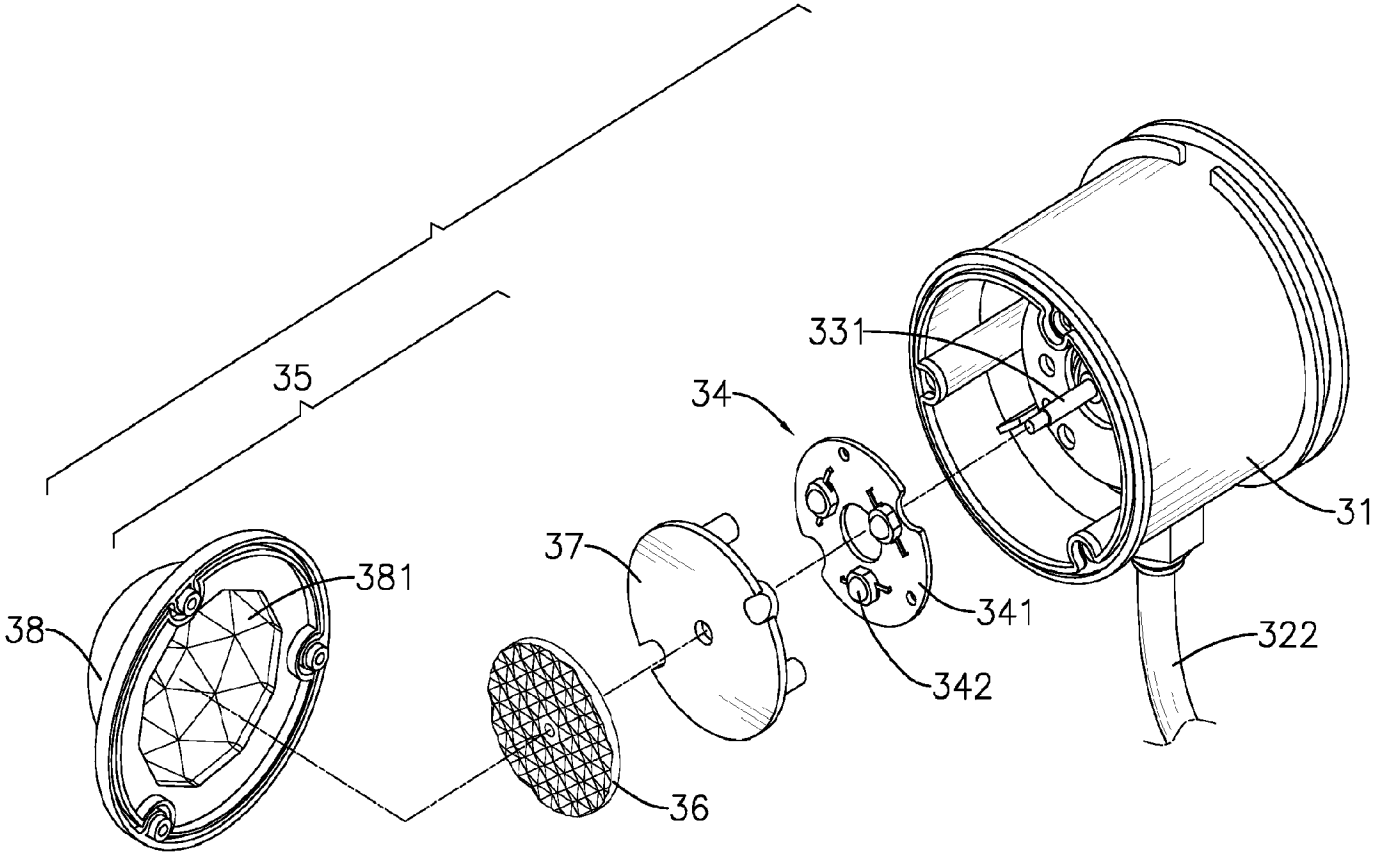
FIG. 3 is an exploded perspective view of the lighting assembly of the inflatable display of FIG. 1.
Figure 4:
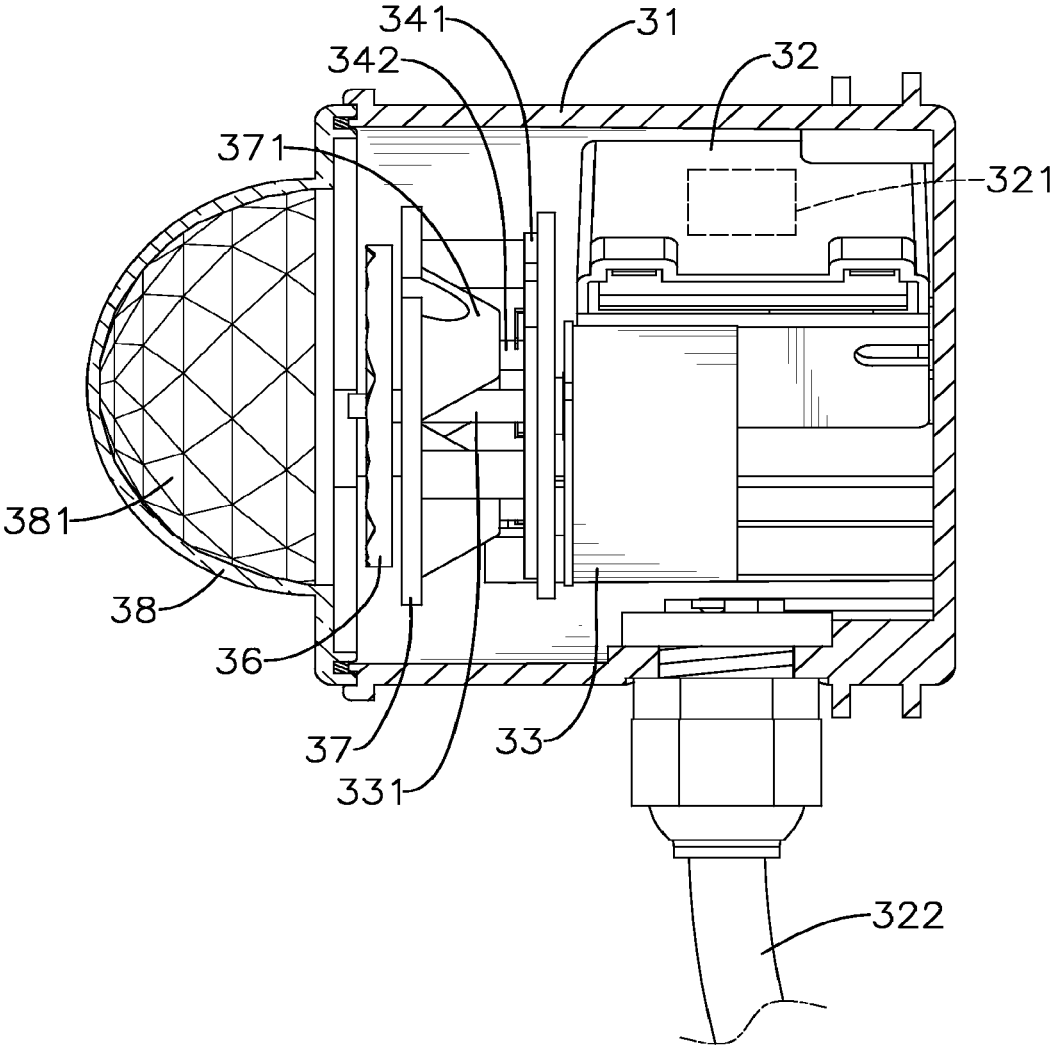
FIG. 4 is a side view in partial section of the lighting assembly of the inflatable display of FIG. 1.

With further reference to FIGS. 2 to 4, the lighting assembly 30 is mounted in the inflatable body 10 on the inner wall of the inflatable body 10, and has a light housing 31, a power supply 32, a motor 33, a lighting module 34, and a refracting module 35.

According to an embodiment, the light housing 31 is hollow and has a front open end and a rear closed end.

The power supply 32 is mounted in the light housing 31, and has a power adapter 321 and a power cord 322. The power adapter 321 converts alternating current (AC) to direct current (DC). The power cord 322 of the power supply 32 is electrically connected to the power adapter 321, extends out of the light housing 31, and is electrically connected to an external power source. Preferably, the power cord 322 of the power supply 32 is electrically connected with the power cord 21 of the air pump 20, and is connected to the external power source via the power cord 21 of the air pump 20.

The motor 33 is mounted in the light housing 31, is electrically connected to the power adapter 321 of the power supply 32, and has a driving shaft 331. The driving shaft 331 protrudes toward the front open end of the light housing 31, and is driven to rotate by the motor 31. The driving shaft 331 may continuously rotate in a specific direction or may rotate back and forth.

The lighting module 34 and the refracting module 35 rotate relative to each other. Specifically, in the first preferred embodiment, the lighting module 34 is mounted in the light housing 31, is electrically connected to the power adapter 321 of the power supply 32, is disposed between the front open end of the light housing 31 and the motor 33, and has a circuit board 341 and multiple light emitting diodes (LEDs) 342. The circuit board 341 is annular, is disposed around the driving shaft 331 of the motor 33, is electrically connected to the power adapter 321 of the power supply 32, and has a front surface and a control unit. The front surface of the circuit board 341 faces the front open end of the light housing 31. The LEDs 342 can emit light beams in different colors, are electrically mounted on the front surface of the circuit board 341 and are controlled by the control unit of the circuit board 341 so as to form a specific lighting mode, such as a flicker mode (each of the LEDs 342 flickers) or a normal mode (each of the LEDs 342 shines continuously).

The refracting module 35 is mounted on the front open end of the light housing 31. The refracting module 35 has a refractive lens 36, a condenser 37, and a light shade 38. The refractive lens 36 is disposed between the front open end of the light housing 31 and the lighting module 34, is securely attached to the driving shaft 331 of the motor 33, and is driven to rotate by the driving shaft 331 of the motor 31. The refractive lens 36 has a front surface. The front surface of the refractive lens 36 faces the front open end of the light housing 31, is irregular and rough, and includes multiple refractive surfaces being planar and inclined at different angles. The condenser 37 is disposed around the driving shaft 331 of the motor 33 and between the refractive lens 36 and the lighting module 34. The condenser 37 has a rear surface and multiple cone protrusions 371. The rear surface of the condenser 37 faces the lighting module 34. The cone protrusions 371 are separately formed on and protrude from the rear surface of the condenser 37, and respectively correspond in position to the LEDs 342 of the lighting module 34. The light shade 38 is hemispherical, caps the light housing 31, and is mounted on and securely attached to the front open end of the light housing 31. The light shade 38 has an inner surface and a beam-splitter lens portion 381. The beam-splitter lens portion 381 is formed on the inner surface of the light shade 38 and includes multiple convex lens units.

In use, the power cord 322 of the power supply 32 that is connected to the external power source transmits the AC to the power adapter 321, and the power adapter 321 converts the AC to DC for supplying electrical power to the motor 33 and the lighting module 34.

Thus, the LEDs 342 emit light beams in different colors and the light beams penetrate through the cone protrusions 371 of the condenser 37. The cone protrusions 371 of the condenser 37 condense and then diffuse the light beams to allow the light beams from the LEDs 342 to further penetrate through the refractive lens 36. In the meantime, the refractive lens 36 is driven to rotate by the driving shaft 331 of the motor 33. As the light beams from the LEDs 342 pass through the refractive lens 36, the light beams in different colors are mixed and then further penetrate through the beam-splitter lens portion 381 of the light shade 38 to allow the light beams from the LEDs 342 to be refracted again by the convex lens units of the beam-splitter lens portion 381 of the light shade 38.

With flickering of the LEDs 342 and rotation of the refractive lens 36, the light beams that pass through the light shade 38 can project outwards to further penetrate through the inflatable body 10 at different angles covering a large area to form a dynamic lighting variation and to exhibit a dynamic lighting effect. Moreover, as the mounting position of the lighting assembly 30 in the inflatable body 10 changes, the lighting effects created on the inflatable body 10 differs as well.

Figure 5:
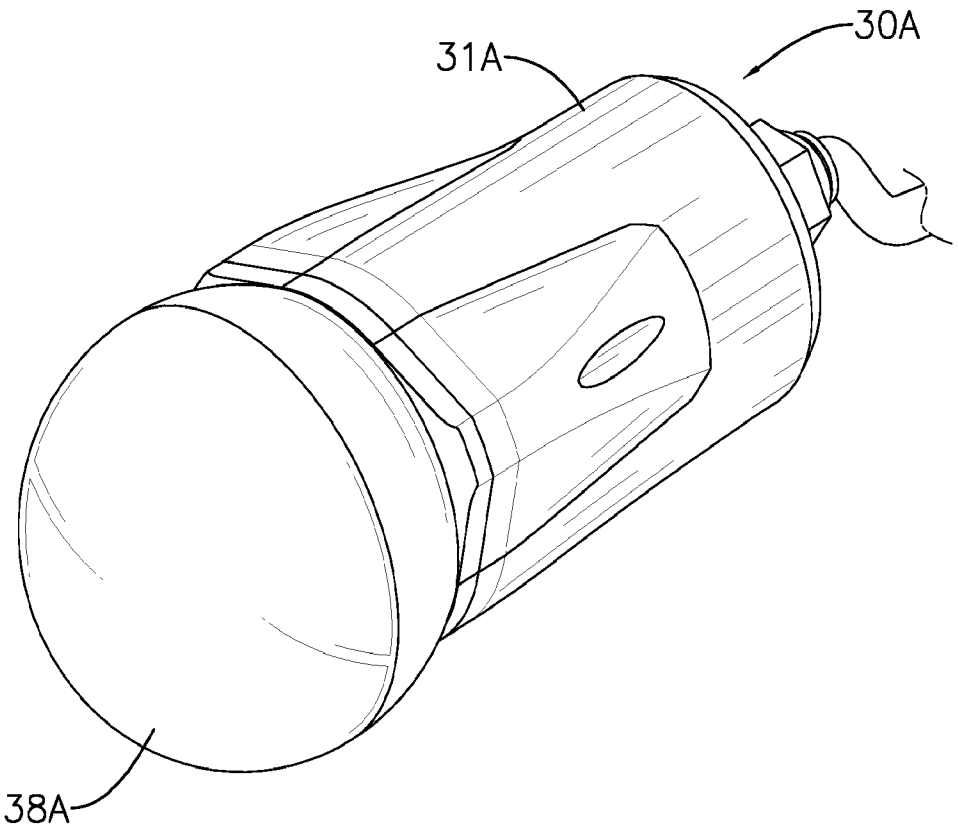
FIG. 5 is a perspective view of a lighting assembly of a second embodiment of an inflatable display with dynamic lighting effect in accordance with an embodiment of the present invention.
Figure 6:
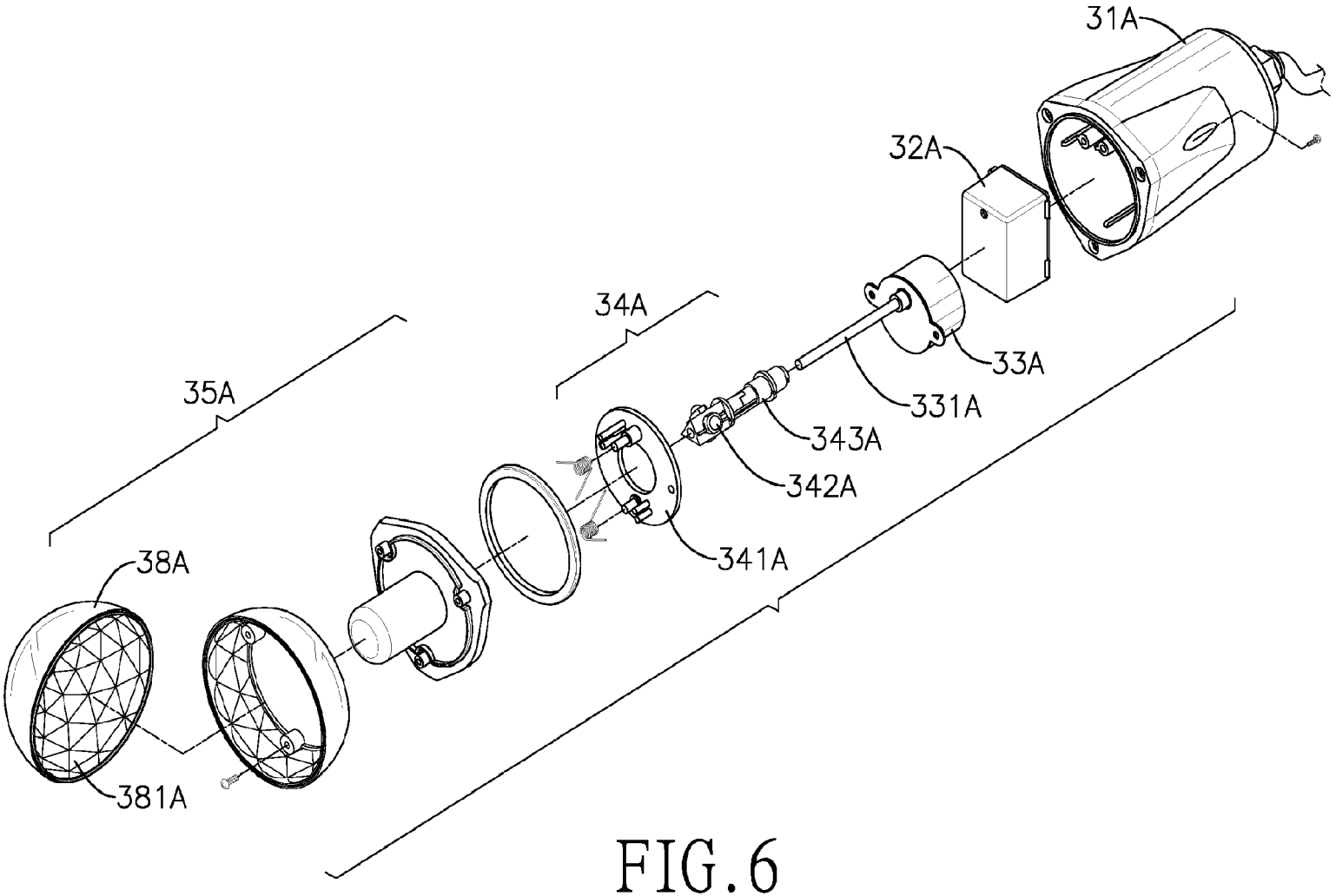
FIG. 6 is an exploded perspective view of the lighting assembly of the inflatable display of FIG. 5.

With reference to FIGS. 5 and 6, in a second preferred embodiment, the lighting module 34A of the lighting assembly 30A has an LED module 343A and a circuit board 341A. The LED module 343A is tubular, is mounted around and attached to the driving shaft 331A of the motor 33A, and is driven to rotate back and forth by the driving shaft 331A of the motor 33A. The LED module 343A has multiple LEDs 342A that can emit light beams in different colors. The circuit board 341A is annular, is disposed around the LED module 343A, and is electrically connected to the LED module 343A and the power supply 32A. The refracting module 35A of the lighting assembly 30A has a light shade 35A. The light shade 35A is spherical, is mounted on and securely attached to the front open end of the light housing 31A, and has an inner surface and a beam-splitter lens portion 381A. The beam-splitter lens portion 381A is formed on the inner surface of the light shade 38A and includes multiple convex lens units.

The light beams from the LEDs 342A penetrate through the beam-splitter lens portion 381A of the light shade 38A to allow the light beams from the LEDs 342A to be refracted by the convex lens units of the beam-splitter lens portion 381A of the light shade 38A. With flickering of the LEDs 342A and rotation of the LED module 343A, the lighting assembly 30A forms a dynamic lighting variation and exhibits a dynamic lighting effect.

The inflatable display with the dynamic lighting effect is entertaining irrespective of whether it is fixedly mounted on a site of an occasion or worn by a wearer, and can be more entertaining when used in a dusky occasion with dim light, such as a Halloween party. The inflatable display with the dynamic lighting effect has improved entertaining and decorative effects.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A light comprising:

a housing including a hollow interior and defining an open front portion and a rear portion opposite the open front portion;

a power supply mounted in the hollow interior of the housing;

a motor mounted in the housing, the motor electrically connected with the power supply and having a motor shaft extending in the direction of the open front portion of the housing;

a lighting module mounted in the housing between the motor and the open front portion of the housing, the lighting module including:

a circuit board electrically connected with the power supply, the circuit board defining a bore hole that extends around the motor shaft, and multiple light emitting diode (LED) units electrically mounted on a side of the circuit board, the LED units facing toward the open front portion of the housing;

a refractive lens connected to the motor shaft, the refractive lens having multiple multi-angle refractive convex-lens bodies formed on a side of the refractive lens that faces away from the rear portion of the housing; and a light shade mounted on the opening of the housing, the light shade having multiple multi-angle refractive convex-lens bodies formed on a side of the light shade facing the side of the refractive lens having the multiple multi-angle refractive lens bodies formed thereon;

wherein the driving shaft of the motor rotates the refractive lens with respect to the light shade and the lighting module.

2. The light of claim 1, further comprising a power cord extending out of the housing.

3. The light as claimed in claim 1, wherein the light shade is hemispherical.

4. The light as claimed in claim 1, further comprising:

a condenser disposed around the driving shaft of the motor between the refractive lens and the lighting module, the condenser having a rear surface facing the lighting module, wherein multiple cone protrusions are separately formed on and protrude from the rear surface of the condenser;

wherein the multiple cone protrusions correspond in position to the LED units of the lighting module.

5. The light of claim 1, further comprising a control unit adapted to control the LED units in a first mode where the LED units emit light continuously, and in a second mode where the LED units flicker.

6. The light of claim 1, wherein the LED units emit light beams in different colors.

* * * * *